US005533854A

United States Patent [19]

Focke et al.

[11] Patent Number: 5,533,854

[45] Date of Patent: Jul. 9, 1996

[54] APPARATUS FOR THE HANDLING OF BLANK STACKS HAVING A BAND

[75] Inventors: Heinz Focke, Verden; Hugo Mutschall, Kirchlinteln, both of Germany

[73] Assignee: Focke & Co. (GmbH & Co.), Verden, Germany

[21] Appl. No.: 184,530

[22] Filed: Jan. 21, 1994

[30] Foreign Application Priority Data

Jan. 20, 1993 [DE] Germany ..... 43 01 169.1

[51] Int. Cl.[6] ..... B65B 69/00

[52] U.S. Cl. ..... 414/412; 83/100; 83/909

[58] Field of Search ..... 414/412, 788, 414/789.1; 198/468.8, 468.11; 83/909, 100, 425; 29/426.4, 564.3

[56] References Cited

U.S. PATENT DOCUMENTS

| | | | |
|---|---|---|---|
| 3,563,360 | 2/1971 | Wickersheim . | |
| 4,696,615 | 9/1987 | Ettischer et al. | 414/412 X |
| 4,976,583 | 12/1990 | Moltrasio | 414/412 X |
| 4,995,784 | 2/1991 | Boisseau | 414/412 X |
| 5,011,467 | 4/1991 | Traegaardh . | |
| 5,074,739 | 12/1991 | Takahashi et al. | 83/909 X |
| 5,163,216 | 11/1992 | Ercums et al. | 29/564.3 |
| 5,197,849 | 3/1993 | Turke | 414/788 |
| 5,340,263 | 8/1994 | Neri et al. | 83/909 X |

FOREIGN PATENT DOCUMENTS

| | | |
|---|---|---|
| 258597 | 4/1989 | European Pat. Off. . |
| 381097 | 8/1990 | European Pat. Off. . |
| 421148 | 4/1991 | European Pat. Off. . |
| 1477003 | 12/1971 | Germany . |
| 3229765 | 2/1984 | Germany . |
| 3443362 | 6/1989 | Germany . |
| 2846020 | 11/1989 | Germany . |
| WO8810226 | 6/1988 | WIPO . |

*Primary Examiner*—Karen B. Merritt
*Assistant Examiner*—Stephen Gordon
*Attorney, Agent, or Firm*—Sughrue, Mion, Zinn, Macpeak & Seas

[57] ABSTRACT

Apparatus for transporting blank stacks (14) surrounded by a band (15). During the transport of the blank stacks (14) in the direction of their longitudinal extension, the band (15) surrounding the blank stack (14) in the transverse direction is severed on the underside (bottom wall 19) by a stationary severing knife (35). The blank stack (14), together with the severed band (15), is conveyed further to a point above a magazine shaft (13, 13*a*). Here, the band (15) is held by suckers (39) and is sucked off via a lateral suction channel (40).

16 Claims, 6 Drawing Sheets

APPARATUS FOR THE HANDLING OF BLANK STACKS HAVING A BAND

Figure 1:
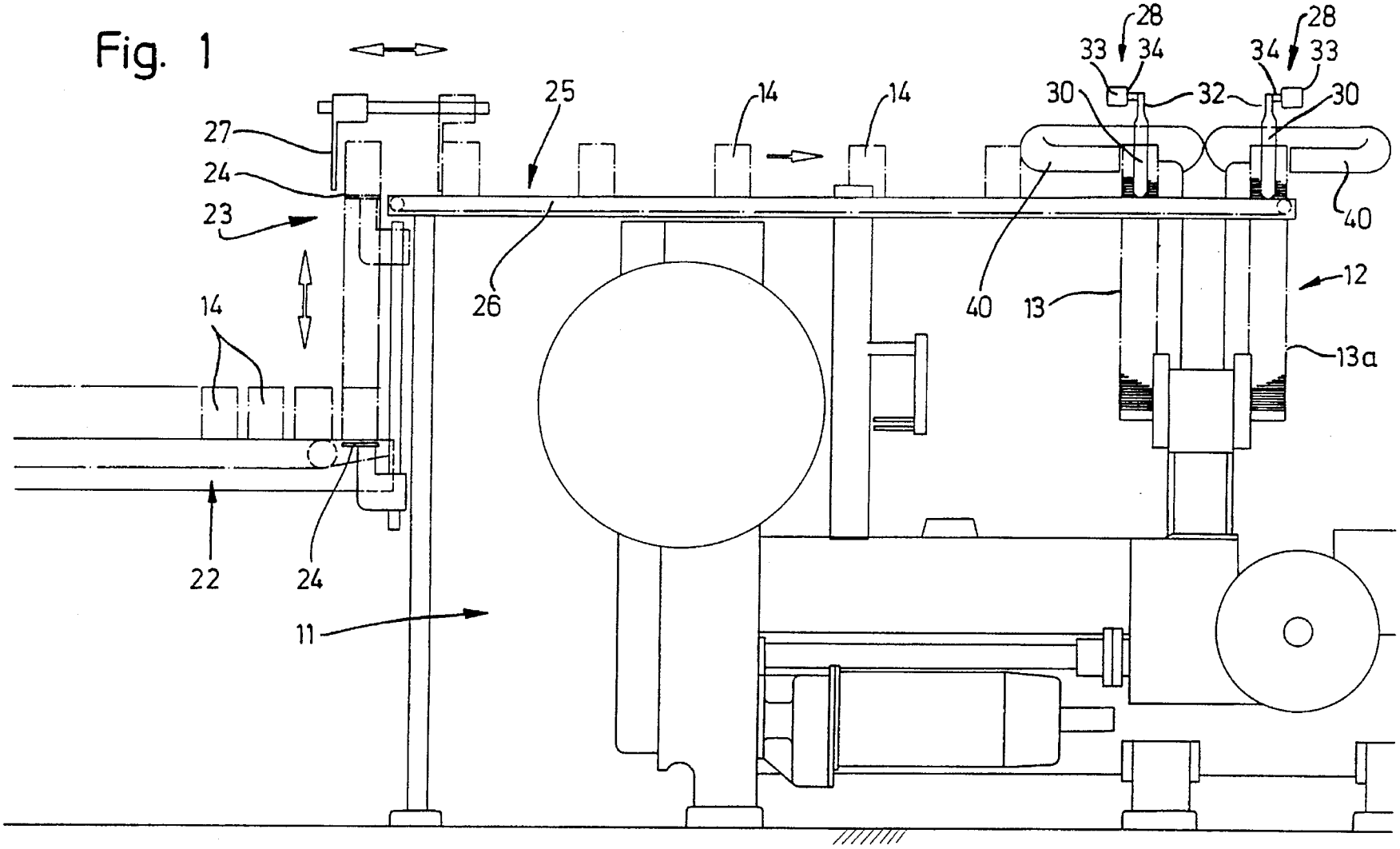

The invention relates to a process for transporting blank stacks surrounded by a band to a blank magazine of a packaging machine, the band being severed by a stationary severing knife during a relative transport movement of the blank stack before the introduction of the blank stack into the blank magazine. The invention relates, furthermore, to an apparatus for the transport and treatment of blank stacks having a band.

Blanks for packs are often prefabricated in a separate operation and supplied as blank stacks to the packaging machine. This handling is customary primarily in respect of blanks for hinge-lid packs receiving cigarettes.

In order to give the blank stacks a better hold, they have recently often been provided with a band consisting of paper or foil. This surrounds the blank stack of elongate, approximately rectangular blanks in the region of longitudinal sides. The band has to be eliminated before the processing of the blanks. For this purpose, the band is severed by hand or mechanically by means of a severing knife. The blank stack freed of the band is then introduced into a blank magazine of the packaging machine.

The object on which the invention is based is to propose measures by which an elimination of the bands is possible in a simple way, without an interruption in the transport flow for the blank stacks and by the use of simple mechanical members.

To achieve this object, the process according to the invention is characterized in that the band is severed by a stationary severing knife on the underside of the blank stack, and in that the band is severed immediately before the transfer of the blank stack to the blank magazine.

In the invention, therefore, the operation of severing the band is brought into accord with the necessarily transport of the blank stacks to the blank magazine. During a final stage of transport, the blank stack is moved past the stationary severing knife which severs the band on the underside of the blank stack. According to a further feature of the invention, the freed band is eliminated by being sucked off.

The blank stacks are delivered by a feed conveyor designed as a band conveyor, specifically with their longitudinal extension transverse to the conveying direction. The blank stacks are pushed off from the feed conveyor by a slide, acting as a transversely directed magazine conveyor, onto carrying members above the blank magazine. Between the feed conveyor and the blank magazine, the stationary severing knife is arranged below the path of movement of the blank stacks.

The carrying members for the blank stacks above the blank magazine are designed as carrier plates which are movable in a horizontal plane and which are moved apart from one another in order to introduce the blank stack into the blank magazine.

It Is important, furthermore, that the blank stacks, before being pushed off from the feed conveyor, that is to say before the execution of the severing cut, be aligned by straightening members which come to bear on the longitudinal sides of the blank stack.

Further features of the invention relate to constructive particulars of the conveyors, severing knife, straightening members, carrier plates and suck-off members.

Figure 2:
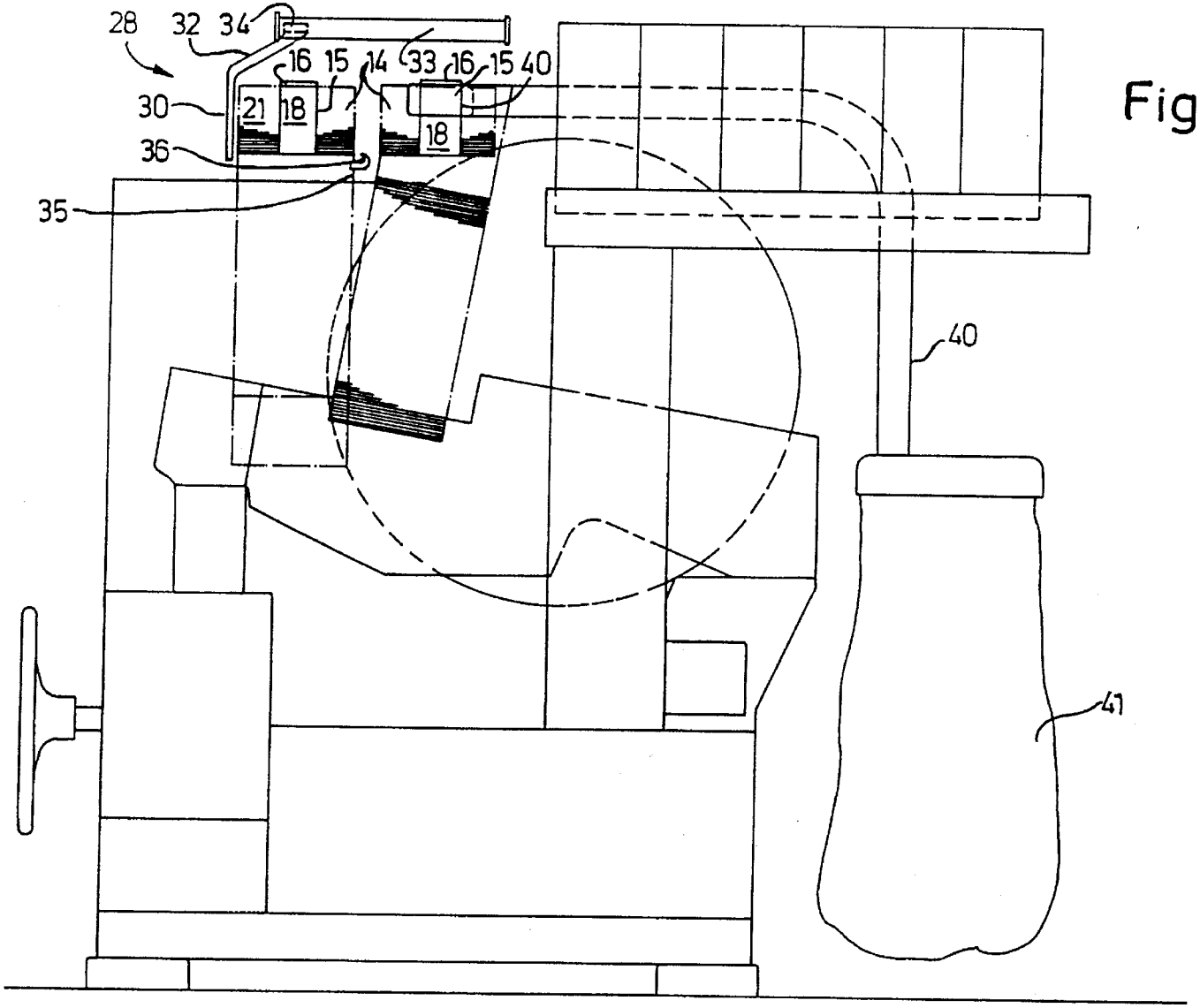
Figure 3:
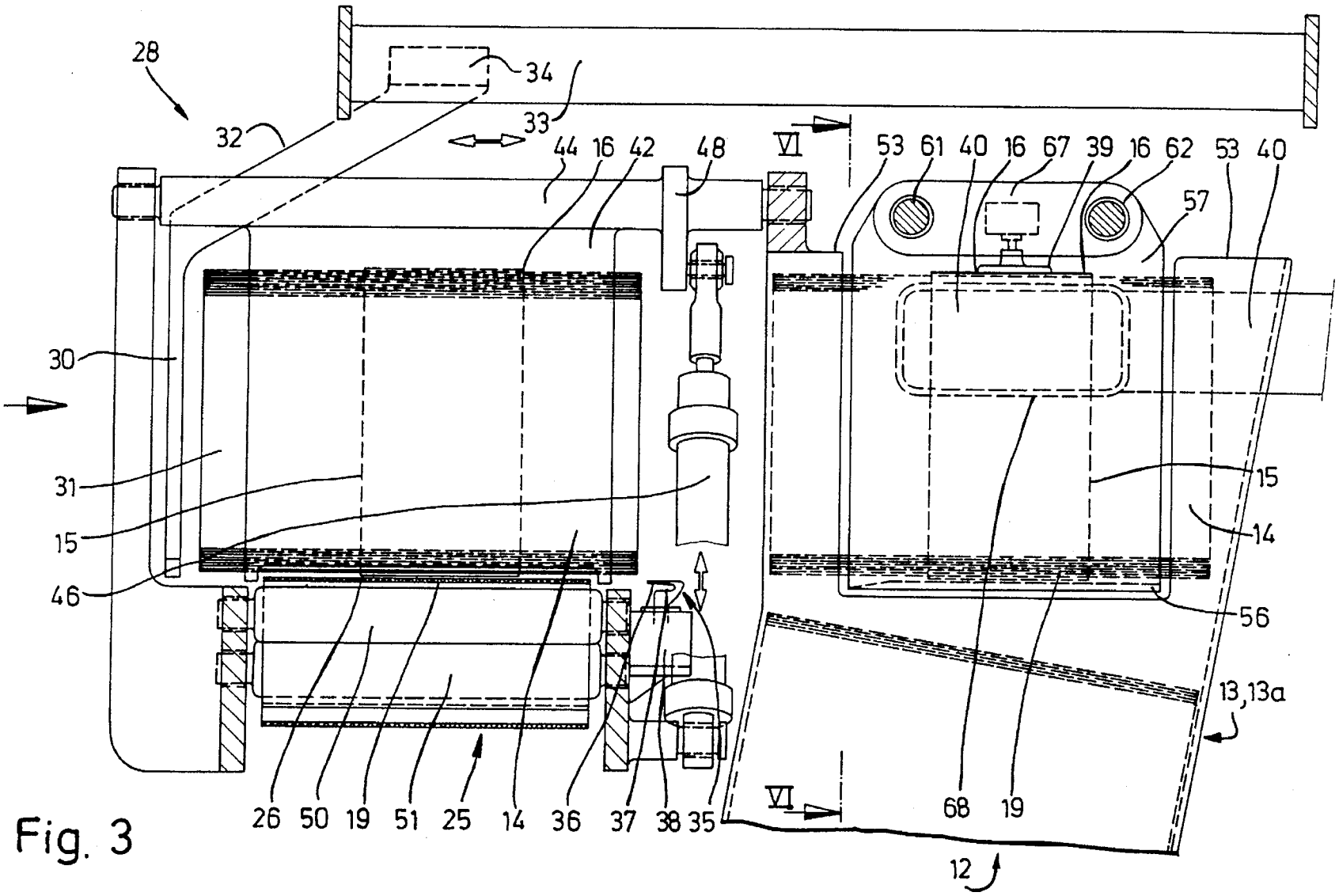
Figure 4:
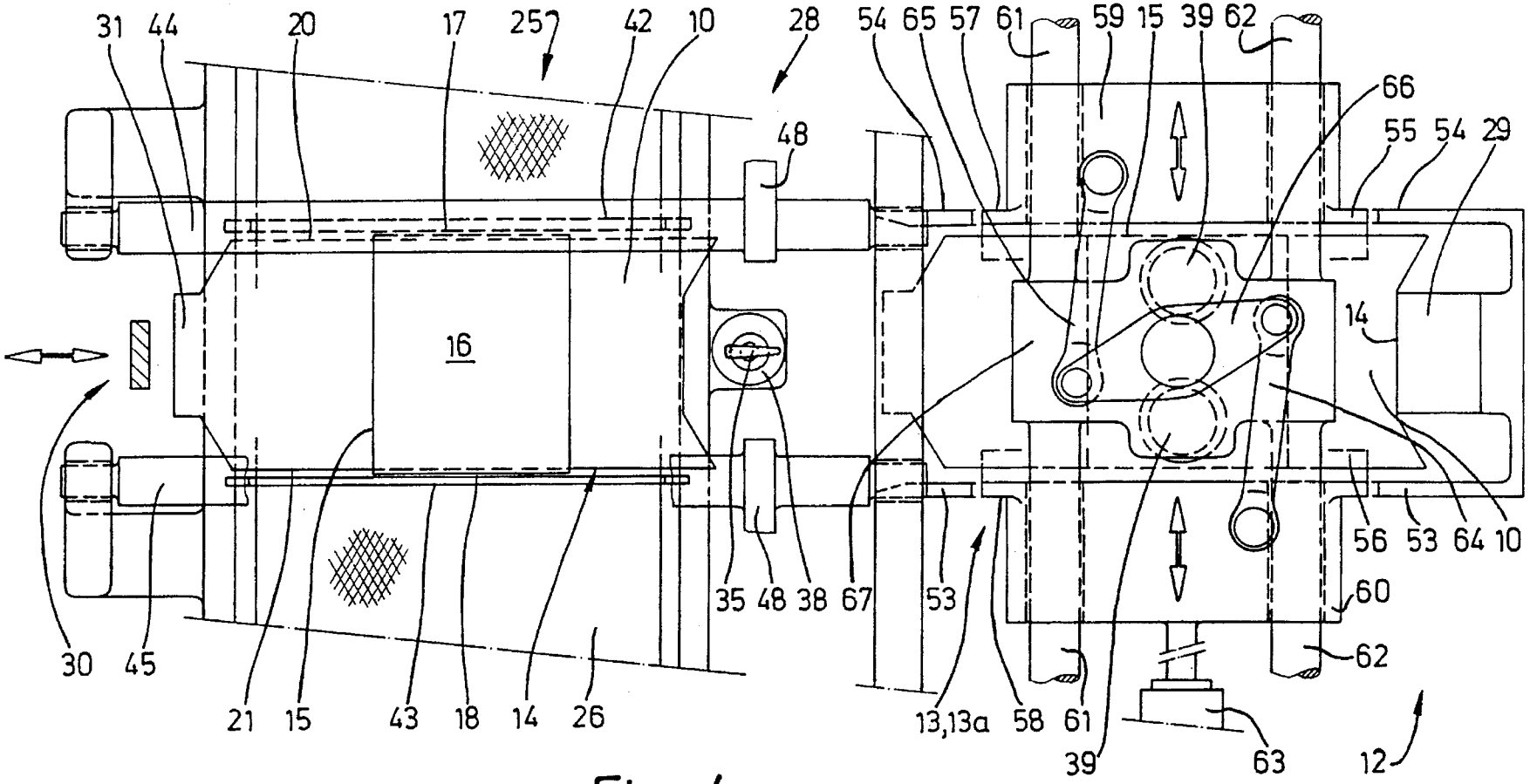
Figure 5:
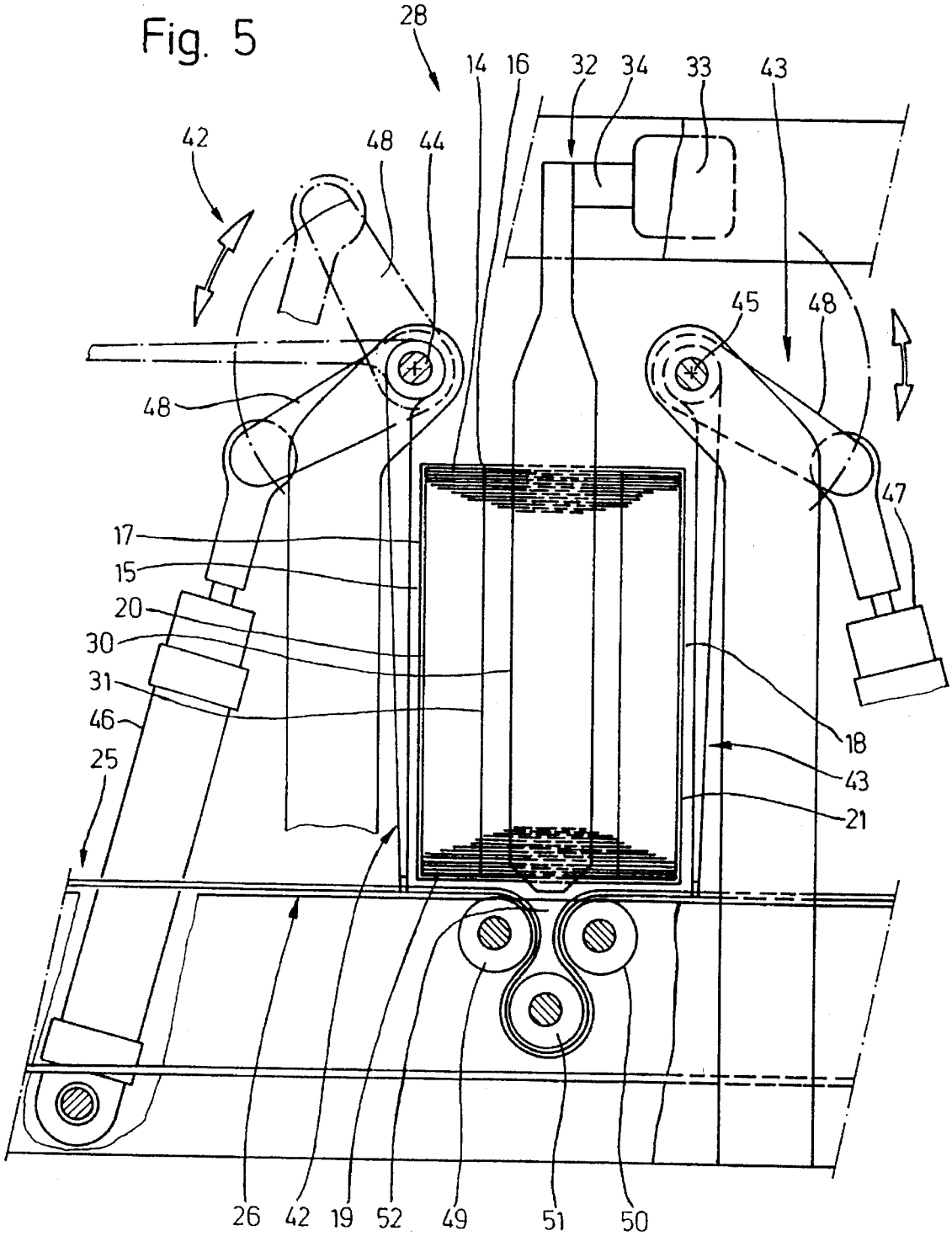
Figure 6:
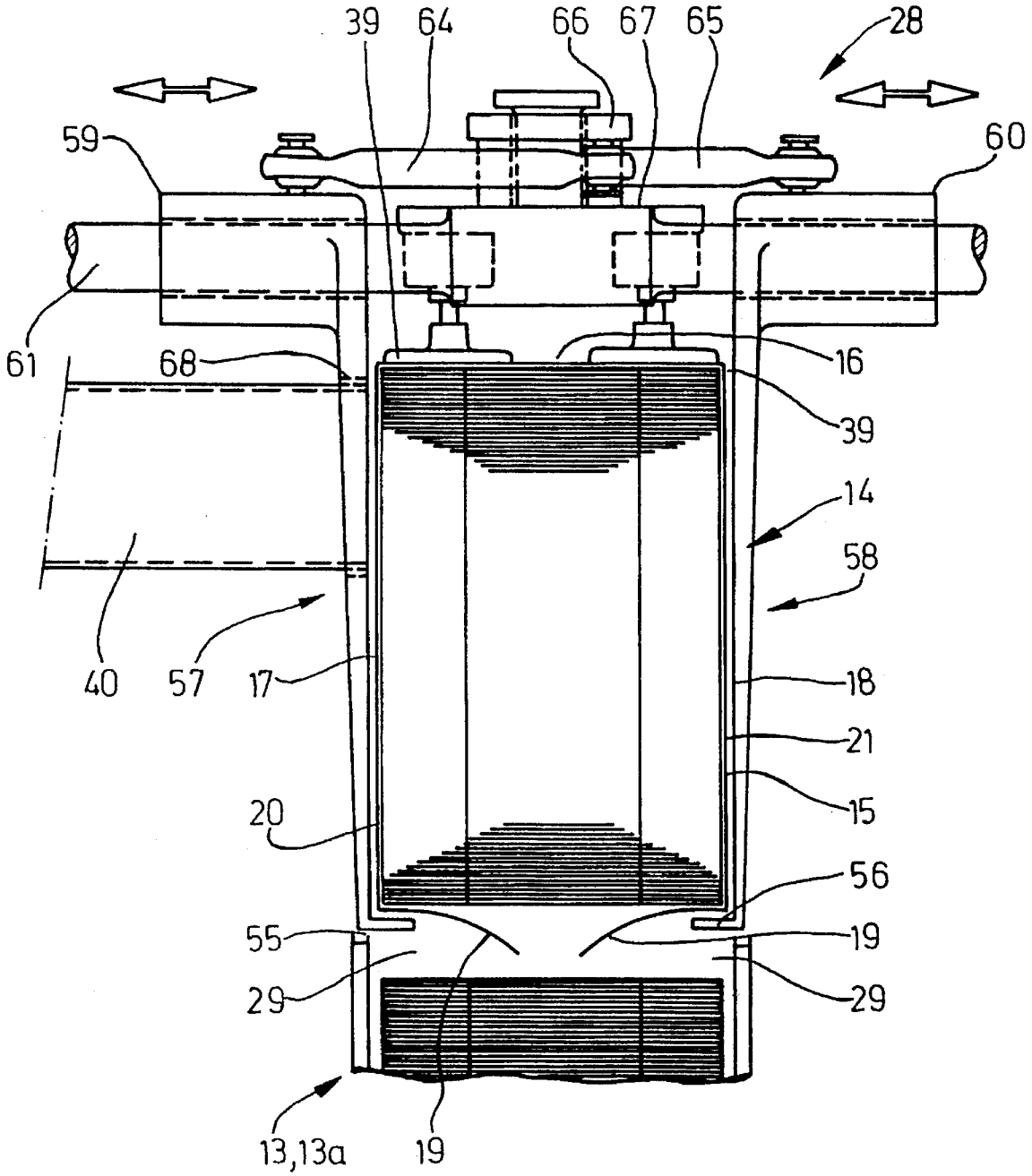

An exemplary embodiment of the apparatus according to the invention is explained in more detail below by means of the drawings. In these:

FIG. 1 shows a diagrammatic side view of an apparatus for handling blank stacks as part of a packaging machine, FIG. 2 shows a detail of the apparatus according to FIG. 1 in a transverse view, on an enlarged scale, FIG. 3 shows a detail from FIG. 2 on a further-enlarged scale, FIG. 4 shows a detail according to FIG. 3 in horizontal projection, FIG. 5 shows a side view of a detail in the region of the feed of a blank stack to the blank magazine, on a further-enlarged scale, FIG. 6 shows a detail according to FIG. 3 in cross-section VI—VI, on an enlarged scale.

The exemplary embodiment illustrated in the drawings is concerned with the handling of blanks 10 for the production of hinge-lid packs for cigarettes or the like. Blanks 10 of this type are elongate and approximately rectangular with the contours typical of this pack. The blanks 10 are produced in a packaging machine 11, of which parts are shown diagrammatically in FIG. 1. A plurality of blanks 10 are located, for individual extraction, in a blank magazine 12. This in turn consists of two magazine shafts 13 and **13*a*** located next to one another.

The blanks 10 are delivered one above the other as blank stacks 14. Each blank stack 14 is surrounded by a band 15 consisting of paper or of another suitable material. The band 15 is located approximately in the middle region of the blank stack 14 having an upper wall 16, side walls 17 and 18 and a bottom wall 19. Side walls and 18 extend in the region of elongate side faces 20 and 21 of the blank stack 14.

Blank stacks 14 designed in this way are delivered by a feed conveyor 22 which, in the present case, is designed as a band conveyor. The blank stacks 14 are supported on era upper conveying strand of the feed conveyor 22 in a continuous series at short distances from one another, specifically with their longitudinal extension transverse to the conveying direction (from left to right in FIG. 1).

The blank stacks 14 are transferred intermittently by the feed conveyor 22 to a lifting conveyor 23. This consists, in the present exemplary embodiment, of a platform 24 movable up and down. This receives one blank stack 14 at a time and transports it to the level of a following stack conveyor 25. This is located on a plane which makes it possible to introduce the blank stacks 14 into the blank magazine 12 from above.

Mere too, the stack conveyor 25 is a belt conveyor with an individual conveyor belt 26 having a width which is somewhat smaller than the length of the blanks 10 or of the blank stacks 14. These are individually pushed in succession onto the stack conveyor 25 at a feed end by a pushing member 27 movable to and fro, in such a way that the successively transported blank stacks 14 are at a greater distance from one another, namely corresponding approximately to the distance between the two magazine shafts 13 and 13a. For this purpose, the stack conveyor 25 is driven at a correspondingly higher speed.

The blank stacks 14 are conveyed by the stack conveyor 25 to a point in front of the magazine shafts 13, **13*a* of the blank magazine 12. In the region of a transfer station 28, the blank stacks 14 are aligned with the associated magazine shaft 13, 13a and are then conveyed transversely relative to the stack conveyor 25 into a position above a filling orifice 29 of one magazine shaft 13, 13*a* or the other. The transfer of the blank stacks 14 to the associated magazine shafts 13, 13*a* takes place by means of a cross-conveyor which pushes off the blank stacks 14 from the conveyor belt 26 and which conveys to the exact position above the magazine shaft 13, 13*a*. In the present exemplary embodiment, this cross-conveyor is a slide 30 which grasps the blank stack 14 in the region of a narrow side, in the present case in the region of projecting collar inner tabs 31 of the blanks 10. The slide 30 is movable transversely until the blank stack 14 has reached the position shown in FIG. 4. In the present case, the slide 30 is connected via a slide am 32 to a drive above the trans far station 28. This is, here, an elongate pressure-medium cylinder 33 having a laterally emerging extension 34 for connection to the slide arm 32 (FIG. 3**).

On the (short) transport run of the blank stack 14 from the conveyor belt 26 to the magazine shaft 13, 13*a*, the band 15 is severed, specifically by a stationary severing knife 35. This is arranged in the region between the stack conveyor 25 and blank magazine 12. The severing knife 35 takes effect on the underside of the blank stack 14 and severs the band 15 here approximately centrally (FIG. 6), that is to say in the region of the bottom wall 19.

The severing knife 35 is designed in a special way, namely hook-shaped with an inner or downwardly directed cutting edge 36. As a result of this design, the severing knife 35 fores an inner gap or slit 37. The band 15, namely its bottom wall 19, penetrates into this during the cutting operation. The cutting edge 36 is directed slightly obliquely.

In order to guarantee a reliable severing cut, the severing knife 35 is movable up and down in the present exemplary embodiment by means of a short-stroke cylinder 38. This is controlled so that the severing knife 35 is raised out of a lower initial position as soon as the blank stack 14 is located above the severing knife 35. The latter is then pressed with slight pressure against the lower blank 10 of the blank stack 14. A particular cavity is thereby formed between the blank stack 14 and the bottom wall 19 of the band 15. The severing knife 35 can then slide along in this region during the execution of the severing cut, the blank stack 14 being moved relative to the severing knife 35.

The blank stack 14, together with the severed band 15, passes into the region above the magazine shaft 13, 13*a*. Here, the band 15 is grasped by (two) suckers 39 specifically in the region of the upper wall During the subsequent movement to lower the blank stack 14 into the magazine shaft 13, 13*a*, the band 15 continues to be held by the suckers 39 and thereby comes free from the blank stack 14.

For the complete elimination of the band 15, the latter is conveyed away, specifically sucked off. For this purpose, a sufficiently dimensioned suction channel 40 opens out in the region above the magazine shaft 13, 13*a*. Each suction channel 40 is connected to a vacuum source and leads to a common collecting container, namely a bag 41, for receiving the bands 15. The suction channel 40 takes effect respectively on a side wall 17 or 18 of the band 15. The latter is drawn into the suction channel 40 as a result of the vacuum and is conveyed into the bag 41.

In order to guarantee an accurate transport of the blank stacks 14 in the region of the transfer station 28, each blank stack 14 is aligned with the stack conveyor 25. Provided for this purpose are plate-shaped aligners 42, 43 which bear on the elongate side faces 20, 21 of the blank stack 14. The width of the aligners 42, 43 is only slightly smaller than the length of the blank stacks 14.

The aligners 42, 43 have primarily the function of aligning the blank stack 14 exactly with the filling orifice 29 of the magazine shaft 13 or 13*a*, so that a rectilinear transverse movement leads to an exact positioning of the blank stack 14 above the respective filling orifice 29. For this purpose, the aligners 42, 43 are mounted pivotably, specifically each in a rotary bearing formed above the blank stack 14. In the present exemplary embodiment, this rotary bearing consists of a rotary rod 44, 45 lying in the longitudinal direction of the blank stack 14. The ends of the rotary rod 44, 45 are mounted rotatably in stationary mountings of the machine frame. An actuating member, namely an actuating cylinder 46, 47, is connected to the rotary rod 44, 45 via a transversely directed lever 48. To-and-fro rotational movements are thus transmitted to the aligners 42, 43 by the actuating cylinder 46, 47.

The mode of operation of the aligner. 42, 43 is designed in such a way that a blank stack 14 arriving on the stack conveyor 25 runs up against the aligner 43 which is the second in the conveying direction. This is accordingly located in the upright position and serves as a stop for the arriving blank stack 14. The other aligner 42, which is the first in the conveying direction, is located, during this phase, in an upper or horizontal position (represented by dot-and-dash lines in FIG. 5). The blank stack 14 can therefore run unimpeded past this aligner 42.

After a blank stack 14 has come to bear on the aligner 43, the aligner 42 is moved into the lower or upright aligning position (FIG. 5). The two aligner. 42, 43 thus bear on the side faces 20, 21, specifically over the full height, of the blank stack 14. The latter at the same time also aligned in respect of the relative position of the individual blanks 10 before the transfer to the blank magazine 12.

For transporting away the blank stack 14 to the blank magazine 12, the two aligner. 42, 43 are retracted from the side faces 20, 21 of the blank stack 14.

The transfer stations 28 for the two magazine shafts 13, 13*a* are supplied by the common stack conveyor 25. The transfer stations 28 are formed in succession in the conveying direction. When the transfer station 28 which is the second in the conveying direction is to be fed (magazine shaft 13*a*), the two aligners 42, 43 of the magazine shaft 13 are moved out of the path of movement of the blank stacks 14, namely by pivoting, so that the respective blank stack 14 can be transported to the transfer station 28 which is the second in the conveying direction.

The slide 30 designed as a vertical web takes effect in the region of a special design of the conveyor belt 26 of the stack conveyor 25. In this region, the conveyor belt 26 is guided via three deflecting rollers 49, 50, 51. The middle deflecting roller 51 is located below the upper deflecting rollers 49, 50. A loop is thereby drawn in the conveyor belt 26. This loop in turn generates a gap 52 in the upper transport plane for the blank stacks 14. The slide 30 takes effect in the region of this gap 52 and can thereby grasp the blank stack 14 reliably over the entire height or project slightly beyond the blank stack 14 at the bottom (FIG. 5).

In the region of the blank magazine 12 or of the magazine shafts 13, 13*a*, lateral guides 53, 54 are formed in a stationary manner above the filling orifices 29 as part of the machine frame. The lateral guides 53, 54 on both sides of each filling orifice 29 receive, in a recess, carrying members for the blank stack 14 to be introduced into the magazine shaft 13, 13*a*. These are carrier legs 55, 56 arranged on both sides of the filling orifice 29. These serve for the temporary support of a blank stack 14 exactly above the filling orifice 29. The carrier legs 55, 56 grasp the blank stack 14 on the underside in the region of longitudinal edges of the respective lower blank 10.

The carrier legs 55, 56 are attached to lateral carrying members, namely to holding walls 57, 58. The carrier legs 55, 56 are movable transversely, specifically in the plane of the lower limitation of the blank stack 14, for the transfer of a blank stack 14 to a magazine shaft 13, 13*a*. For this purpose, in the present case, the holding walls 57, 58 are mounted displaceably above the magazine shafts 13, 13*a*. A transversely directed holding piece 59, 60 is mounted displaceably on two carrier rode 61, 62 arranged at a distance from one another. The carrier legs 55, 56 can thereby be moved, together with the holding walls 57, 58, in a direction towards one another into a carrying position (FIG. 6) and apart from one another into a position, in which the filling orifice 29 is freed.

The actuation of the carrier legs 55, 56 via the holding walls 57, 58 and the holding pieces 59, 60 takes peace by means of a common adjusting cylinder 63. In the present case, this is connected directly to a holding piece 60. The latter is accordingly moved to and fro directly on the carrier rods 61, 62 by means of the adjusting cylinder 63. This movement is transmitted via an oppositely directed connecting gear to the other holding piece 59 and therefore to the other carrier leg 55. The connecting gear consists, here, of the links 64 and 65 and of a central rotary piece 66 arranged in the middle. The latter is rotatably mounted centrally above the filling orifice 29 on a connection piece 67 for the two carrier rods 61, 62. The links 64, 65 are connected pivotably to the rotary piece 66 on opposite sides of an axis of rotation of the latter. This results in an exact mutually coordinated and opposed movement of the carrier legs 55, 56 as a result of actuation by means of a common adjusting cylinder 63.

In the present example, the suction channel 40 passes through a holding wall 57 in the region of a recess 68.

We claim:

1. An apparatus including a blank magazine of a packaging machine for transporting blank stacks (14), each surrounded by a band (15), downstream in a transport direction along a path of movement for transfer to said blank magazine (12) of said packaging machine, said apparatus comprising:

a) upstream of the magazine, a belt conveyor (25) on which the blank stacks (14) are conveyed at a distance from one another, transversely to a longitudinal dimension of the stacks, b) the magazine (12) being disposed laterally adjacent to and below a conveying plane of the belt conveyor (25);

c) means for pushing off the individual blank stacks (14) in a direction transverse to a conveyance direction of the belt conveyor (25), i.e. in the direction of the longitudinal dimension of the blank stacks (14), up to a position above the magazine (12); and d) between the belt conveyor (25) and the magazine (12), a stationary severing knife (35) past which the blank stacks (14) are pushed off from the conveyor belt, and which severs each band.

2. The apparatus as claimed in claim 1, comprising:

means for causing said knife to sever each band (15) immediately before the transfer of each blank stack (14) to the blank magazine (12), and means for causing said knife to exert pressure on an underside of each blank stack (14) in a region of each respective band (15) during and before the severing, in such a way that a cavity is produced between each band (15) and each respective blank stack (14).

3. The apparatus as claimed in claim 2, further comprising means for transporting away each band (15), after being severed.

4. The apparatus as claimed in claim 1, wherein the severing knife (35) is movable up and down.

5. The apparatus as claimed in claim 1, further comprising a stop face above the conveying plane of the belt conveyor (25), said belt conveyor (25) transporting the blank stacks against the stop face where they are pushed off from the belt conveyor in the transverse direction towards the magazine.

6. The apparatus as claimed in claim 1, wherein the belt conveyor (25) has a conveyor belt (26) on which the blank stacks (14) rest, wherein said pushing off means comprises a transversely movable slide (30), and wherein the stacks are conveyed past the severing knife (35) as far as the blank magazine (12) into a position above a filling orifice (29) thereof.

7. The apparatus as claimed in claim 6, wherein the belt conveyor (25) has a conveyor belt (26) that forms a gap (52) in a path of movement of the slide (30).

8. The apparatus as claimed in claim 6, wherein there are arranged at an end of the path of movement of the blank stacks (14) two plate-shaped aligners (42, 43) which, for the alignment of the blanks (10) and of each blank stack (14), come to bear on opposite longitudinal sides of each stack, the plate-shaped aligners (42, 43) being mounted pivotably above the path of movement of the blank stacks (14).

9. The apparatus as claimed in claim 8, wherein the one aligner (43) of said two aligners which is second in the transport direction of arriving blank stacks (14), serves as a stop for each blank stack (14) at the end of the belt conveyor (25), and further comprising means for moving the other aligner (42) of said two aligners out of the path of movement of each blank stack (14).

10. The apparatus as claimed in claim 6, further comprising carrier legs (55, 56), and wherein each blank stack (14) is placed on the filling orifice (29) of the blank magazine (12) on said carrier legs (55, 56) on which each blank stack (14) rests with mutually opposite edge regions of longitudinal sides thereof.

11. The apparatus as claimed in claim 10, further comprising, for the transfer of each blank stack (14) to said magazine, means for moving the carrier legs (55, 56) apart from one another, in an essentially horizontal plane, in such a way that the filling orifice (29) if freed.

12. An apparatus for transporting blank stacks (14), surrounded by a band (15), in a transport direction along a path of movement to a blank magazine (12) of a packaging machine, said apparatus comprising:

a) a belt conveyor (25);

b) a blank magazine (12) with two magazine shafts (13, 13*a*) which are fed by said belt conveyor (25) and which are disposed in succession at a side of the belt conveyor (25) in said transport direction, c) the belt conveyor being adjacent two transfer stations (28) that are disposed in succession in the transport direction;

d) means for pushing off the blank stacks (14) from the belt conveyor (25) transversely towards a respective one of the respective magazine shafts (13, 13*a*) at each of the transfer stations (28); and e) above a conveying plane of the belt conveyor (25), two aligners (42, 43) at each transfer station (28) for contacting and aligning the blank stacks (14) before the transverse pushing-off from the belt conveyor (25) toward one of the two magazine shafts (13, 13*a*).

13. The apparatus as claimed in claim 12, wherein the aligners (42, 43) that are forward in the transport direction of the belt conveyor are movable out of the path of movement of the blank stacks for feeding the magazine shaft (13*a*) which is behind in said transport direction.

14. The apparatus as claimed in claim 12, wherein the aligners (42, 43) are arranged at an end of the path of movement of the blank stacks (14), are plate-shaped, come to bear on opposite longitudinal sides of each stack, and are pivotably mounted above the path of movement of the blank stacks (14).

15. The apparatus as claimed in claim 14, wherein the aligner (43), that is second in the transport direction of the arriving blank stacks (14) at the transfer station, serves as a stop for each blank stack (14), and further comprising means for moving the other aligner (42) out of the path of movement of each blank stack (14).

16. An apparatus including a blank magazine of packaging machine for transporting blank stacks (14), each surrounded by a band (15), downstream in a transport direction along a path of movement for transfer to said blank magazine (12) of said packaging machine, said apparatus comprising:

a) upstream of the magazine, a belt conveyor (25) on which the blank stacks (14) are conveyed at a distance from one another, transversely to a longitudinal dimension of the stacks, b) the magazine (12) being disposed laterally adjacent to and below a conveying plane of the belt conveyor (25);

c) means for pushing off the individual blank stacks (14) in a direction transverse to a conveyance direction of the belt conveyor (25), i.e. in the direction of the longitudinal dimension of the blank stacks (14), up to a position above the magazine (12);

d) between the belt conveyor (25) and the magazine (12), a stationary severing knife (35) past which the blank stacks (14) are pushed off from the conveyor belt, and which severs each band;

e) wherein said blank magazine has a blank shaft having a filling orifice through which the blanks are transferred to the blank magazine;

said apparatus further comprising:

f) suckers (39) for holding each severed band (15) until it is transported away, said suckers (39) being arranged in a region above said filling orifice (29), g) the suckers (39) grasping each band (15) in a region of an upper wall (16); and h) a suction channel (40) for transporting away each severed band (15), i) wherein the suction channel (40) opens out in a region of the magazine shaft (13, 13*a*) above the filling orifice (29), in such a way that each band (15) held by the suckers (39) is grasped on a side wall (17) by the suction channel (40).

* * * * *